United States Patent [19]

Brouwer

[11] 4,049,197

[45] Sept. 20, 1977

[54] SPRAY DISPENSER

[75] Inventor: Frans Brouwer, Glencoe, Ill.

[73] Assignee: Albert E. Sloan, Chicago, Ill.

[21] Appl. No.: 622,908

[22] Filed: Oct. 16, 1975

[51] Int. Cl.[2] ..... B05B 3/08

[52] U.S. Cl. ..... 239/218.5; 239/222; 239/224; 239/332

[58] Field of Search ..... 239/215, 218.5, 219, 239/221, 222, 222.11, 222.13, 222.15, 223, 224, 332, 124; 222/285, 28 6, 290, 333; 251/215, 218-224, 251, 252, 264, 266-270, 273, 274

[56] References Cited

U.S. PATENT DOCUMENTS

| | | | |
|---|---|---|---|
| 2,086,921 | 1/1937 | Norris | 239/218.5 |
| 3,074,650 | 1/1963 | Kanarek | 239/219 X |
| 3,455,507 | 7/1969 | Ryder et al. | 239/215 |

*Primary Examiner*—Evon C. Blunk
*Assistant Examiner*—Andres Kashnikow
*Attorney, Agent, or Firm*—Dressler, Goldsmith, Clement, Gordon & Shore, Ltd.

[57] ABSTRACT

A spray dispenser for dispensing liquid in spray form, having a housing, a rotatable spraying disk mounted to the housing, a liquid feeder for supplying liquid from a receptacle to the underside of the disk, and a fixed member spaced below the underside of the disk. The fixed member cooperates with the disk to define a metering opening which regulates the volume of liquid fed to the disk and which can be set in a zero position. A fixed threaded collar is in threaded engagement with a control cap having a tapered inner flange. A matching tapered member positioned within the flange is movable axially to urge the inner flange outwardly into fixed engagement with a bearing sleeve; and if this is done when the metering opening is in the zero position, it will remain so adjusted and no other zero adjustment need be made to the system to indicia control or preset the dispensing rate of fluid from the dispenser inasmuch as the sleeve is connected to the disk so that rotation of the cap varies the size of the metering opening. A deflector is provided to direct excess liquid back into the receptacle and thereby avoid liquid dripping outside the dispenser. The liquid feeder, fixed member and deflector are integral and detachable from the spray dispenser to facilitate cleaning. Also, a movable gate is suspended between the deflector and housing to vary the arc of the spray of liquid being dispensed.

12 Claims, 4 Drawing Figures

18
9
7
5
3
1
2.
10
99
16
99
26
22
22
16
12
2.

22
72
73
94
16
91
92
30
77
28
92
91
70
14
74
26
15
63
62
93
72
22

10
86
78
80
79
49
81
83
87
84
47
82
53
54
58
48
24
42
46
45
18
43
44
57
20
36
40
35
35a
61
60
59
60a
99
97
58
55
17
52
51
91
19
91
89
56
92
64
34
92
39
88
15
14
94
66
65
26
16
63
62
32
69
96
98
41
72
93
75
95
3
73
70
74
73
93
3
38
37
30
28
12
77

SPRAY DISPENSER

BACKGROUND OF THE INVENTION

This invention relates to a spray dispenser, and more particularly, to a motor driven spray gun for dispensing a liquid such as paint. Although paint is a specific example of a type of liquid which can be dispensed by the apparatus of the present invention, it is to be understood that other liquids may also be dispensed and that no limitation with respect to paint is intended.

In prior art dispensing apparatus, such as U.S. Pat. No. 3,455,507 to Ryder and Brouwer, the paint is held in a receptacle detachably connected to a housing. A partition wall extends across the housing, and a flange depends from the partition wall. The paint is sprayed outwardly by a spraying disk affixed to the shaft of a motor for driving the disk. The underside of the disk is spaced above the upper edge of a bushing which is supported on the hub of a support plate secured to a lower flange portion of the housing. The bushing cooperates with the disk to define a metering opening through which the paint is forced by a screw conveyor. The dimension of the metering opening is regulated by moving the spraying disk axially. The parts of the apparatus that must be moved to move the disk axially are free of the paint and easily movable. The paint is sprayed outwardly and exits the apparatus through an opening in the lower flange portion of the housing, the sides of the opening being adjustable by a movable gate which is mounted to the apparatus. A deflector shield is mounted between the partition wall and the support plate to intercept excess paint and direct the paint back into the receptacle.

The disadvantages of the above-described apparatus are the tolerance problems in initially setting the metering opening at the zero position, and the difficulty of cleaning the apparatus because the deflector shield, the screw conveyor, and the bushing, as well as the movable gate, are separate parts which are mounted to the spray dispenser.

SUMMARY OF THE INVENTION

The spray dispenser of the present invention provides a means for easily and accurately setting the metering opening at the zero position. A fixed threaded collar is in threaded engagement with a control cap having a tapered inner flange. A tapered member positioned within the flange is movable axially to move the inner flange outwardly into fixed engagement with a bearing sleeve when the metering opening is in the zero position. The bearing sleeve remains axially movable with respect to the collar, and is connected to the disk so that rotation of the cap varies the size of the metering opening.

A deflector is provided to intercept excess paint which is sprayed outwardly by a spraying disk. The deflector, the housing for the screw conveyor, and the bushing comprise a deflector assembly which is a single member readily detachable from the spray dispenser to facilitate cleaning. A movable gate is suspended between the deflector and the housing of the spray dispenser to vary the arc of the spray of liquid being dispensed, the suspended nature of the gate facilitating removal and cleaning of the gate when the deflector assembly is removed.

DETAILED DESCRIPTION OF THE ILLUSTRATED EMBODIMENT

Figure 1:
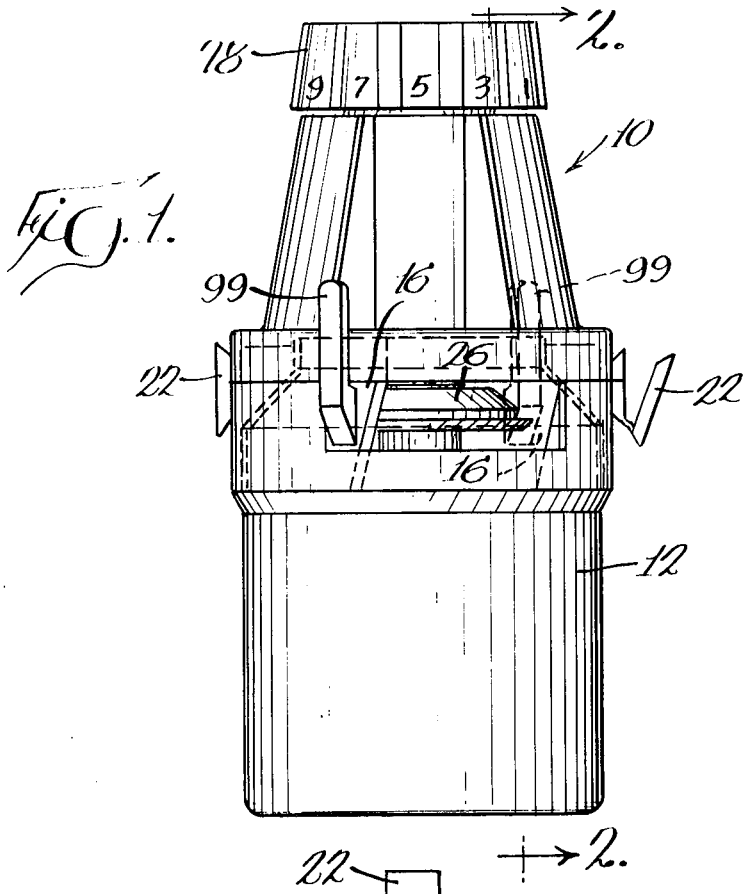
FIG. 1 is a front elevational view of the spray dispenser of the present invention with the gate being shown in solid lines in the open position, and in phantom in the closed position.

The spray dispenser 10 shown in the drawings, is a motor driven spray gun for dispensing a liquid such as paint, and includes a receptacle 12 which is detachably connected to a housing 18. The receptacle 12 defines the reservoir in which the liquid is stored, and has an opening therein through which the liquid is dispensed. The liquid is sprayed outwardly by a motor spraying disk 26, the underside of which is spaced above the upper edge of a bushing 32 to define a metering opening through which the liquid is forced by the screw 28 of a screw conveyor. When the dispenser is in operation, the liquid which is to be dispensed is drawn upwardly from the reservoir through the metering opening, the size of which can be adjusted to control the spray rate of the system, the details of which are described in detail below. According to the present invention, means is provided to eliminate the tolerance problem of establishing a zero opening through the metered opening, as described in detail below.

A deflector 15 is provided to intercept liquid which is not directed through the opening in the receptable and to direct the excess liquid back into the receptacle 12. The deflector 15 is part of the deflector means 14 which is a one-piece unit (FIG. 4) that is mountable to and detachable from the housing 18 to facilitate cleaning, and includes a support means which supports the bushing 32. The detachable nature of the deflector means 14 facilitates in cleaning the spray dispenser 10. A movable gate 16 is provided to cover or uncover a portion of the opening in the receptacle to increase or reduce the area through which the liquid is dispensed, and the gate is suspended between the receptacle 12 and the deflector means 15 to further facilitate in cleaning the assembly.

Figure 2:
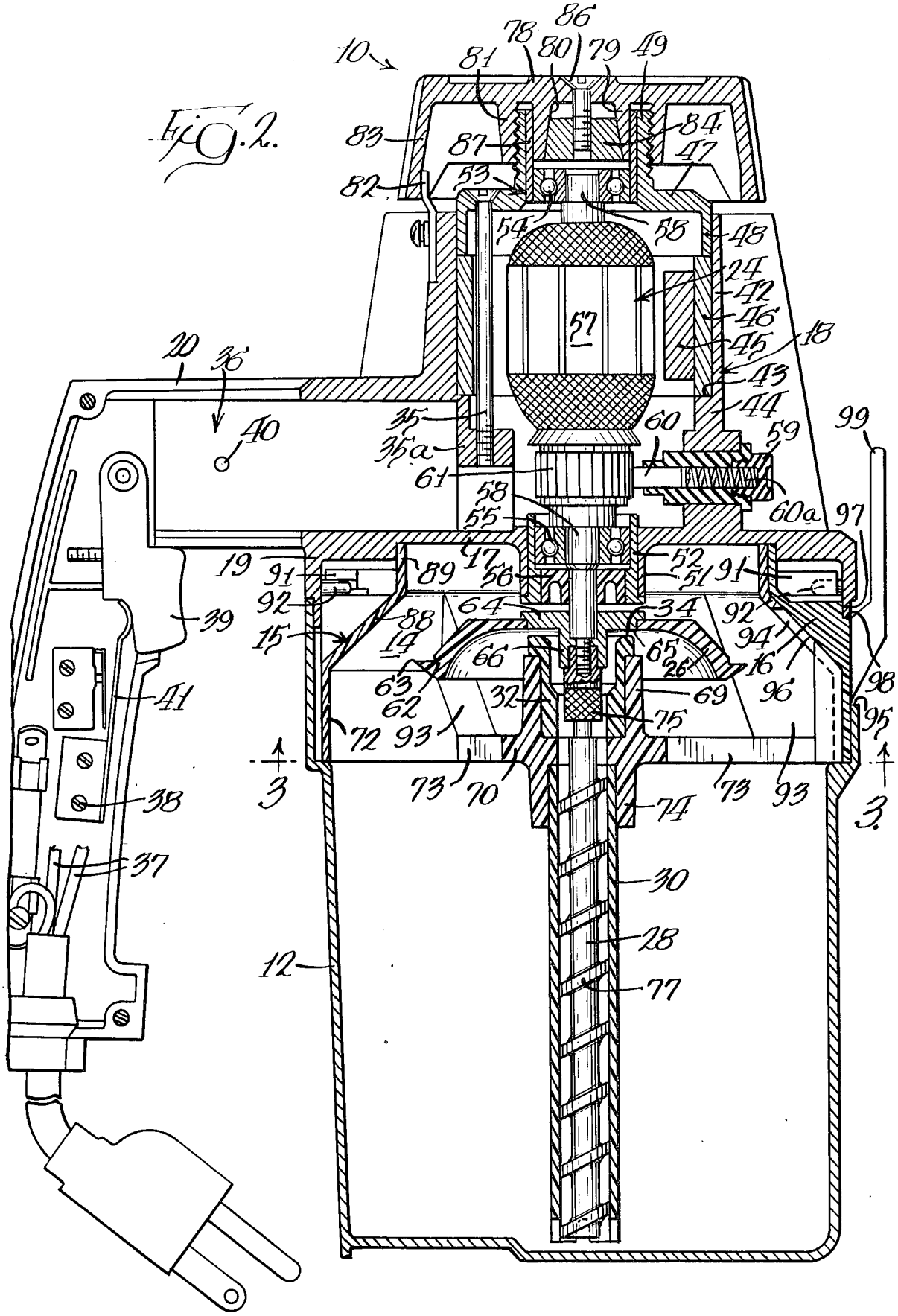
FIG. 2 is a cross-sectional view taken along the plane 2—2 in FIG. 1.
Figure 4:
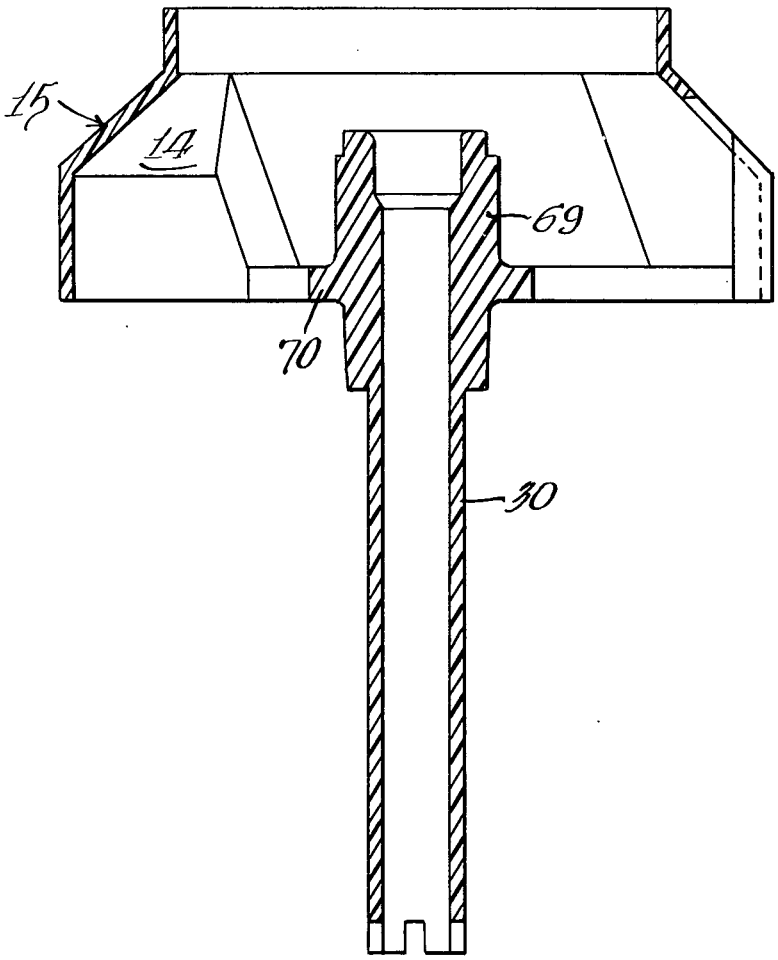
FIG. 4 is a cross-sectional view of a part of the spray dispenser.

As illustrated in FIG. 2, the spray dispenser 10 includes a housing 18 having a handle 20 extending therefrom for holding and transporting the spray dispenser. A partition wall 17 extends across the housing 18 and a flange 19 depends from the partition wall. The liquid receptacle 12 is detachably connected to a lower portion of flange 19 by means of latches 22. The housing 18 encloses an electrical motor 24 which drives a spraying disk 26 and the screw 28 of a screw conveyor which draws liquid upwardly from the receptacle when the dispenser is in operation. The screw conveyor includes a feed tube 30 which is part of deflector means 14 (FIG. 4). The feed tube 30 is immovably connected to a bushing 32 having a top rim 34 which is positioned adjacent the inner surface of the spraying disk 26. The bushing 32 and spraying disk 26 define a metering opening through which the liquid is forced by the screw conveyor.

A motor speed control circuit 36 is mounted in the handle 20 and is connected in series with lines 37 which are used for connecting the electric motor 24 to a current source. An off-on switch 38, which is actuated by trigger 39 extending through an opening in the handle 20, is used to provide rapid starting and stopping of the electric motor 24. When the trigger 39 is pulled, the motor speed control circuit 36 is completed, and the speed of the motor 24 can be varied by turning a knob (not shown) which is keyed to the shaft 40 of a speed control potentiometer. The potentiometer is connected to vary the firing of a silicon controlled rectifier of a conventional SCR motor speed control circuit. When the trigger 39 is released, it is urged to its off position by a spring 41. This causes a load resistor to be connected across the motor armature terminals, thereby creating an effective brake. Pulling on the trigger 39 to start the motor disconnects the load resistor from the circuit.

The housing 18 includes an open ended cylindrical wall 42 on the opposite side of the partition wall 17 than the flange 19. Cylindrical wall 42 has an inner shoulder 43 and a reduced inner diameter portion 44, the significance of which is explained below. The permanent magnets 45 of the motor field structure are secured within a soft steel ring 46 by an adhesive, such as an epoxy resin. The ring 46, with the magnets 45 secured thereto, is mounted to the housing 18 with the lower end of the ring resting on the shoulder 43. A top plate 47 having a lower cylindrical wall 48 resting on the opposite end of the ring 46 and adjacent to the upper portion of the cylindrical wall 42 partially closes the upper end of the cylindrical wall 42. The plate 47 is held in a fixed position by screws 35 threaded into lugs **35*a* extending inwardly from the cylindrical wall 42. The top plate 47 has a centrally disposed upstanding externally threaded tubular collar 49, and the partition wall 17 has a tubular collar 51 depending therefrom in axial alignment with the collar 49**.

A bearing slide assembly 53, mounted in the collar 49, has a ball bearing 54 and bearing sleeve 87 mounted therein. A second ball bearing 55 and bearing sleeve 52 is mounted in the collar 51, and a shaft seal 56 is mounted in the collar 51 below the bearing 55. A shaft 58 has its ends journalled in the bearings 54 and 55, and a rotor 57 is centrally located in ring 46 and has the shaft 58 projecting from the opposite ends thereof. Diametrically opposed brush housings 59 extending through the wall 42 each support a brush 60 which is biased by a spring **60*a* into contact with a commutator 61 secured to the shaft 58**.

The inverted cup-shaped spraying disk 26 is secured to the lower end of the shaft 58 within the cylindrical wall 42 of the housing 18 below the partition wall 17, and has a lower edge 62 which is inclined upwardly from the inner surface of the disk and terminates in a sharp peripheral edge 63. When the motor 24 rotates the spraying disk 26 at high speed, the liquid which is fed to the inner concave surface of the disk is forced outwardly by centrifugal force and moves up the inclined surface 62. When the liquid reaches the sharp peripheral edge 63, it is thrown outwardly therefrom in the form of substantially a "sheet" of spray.

Figure 3:
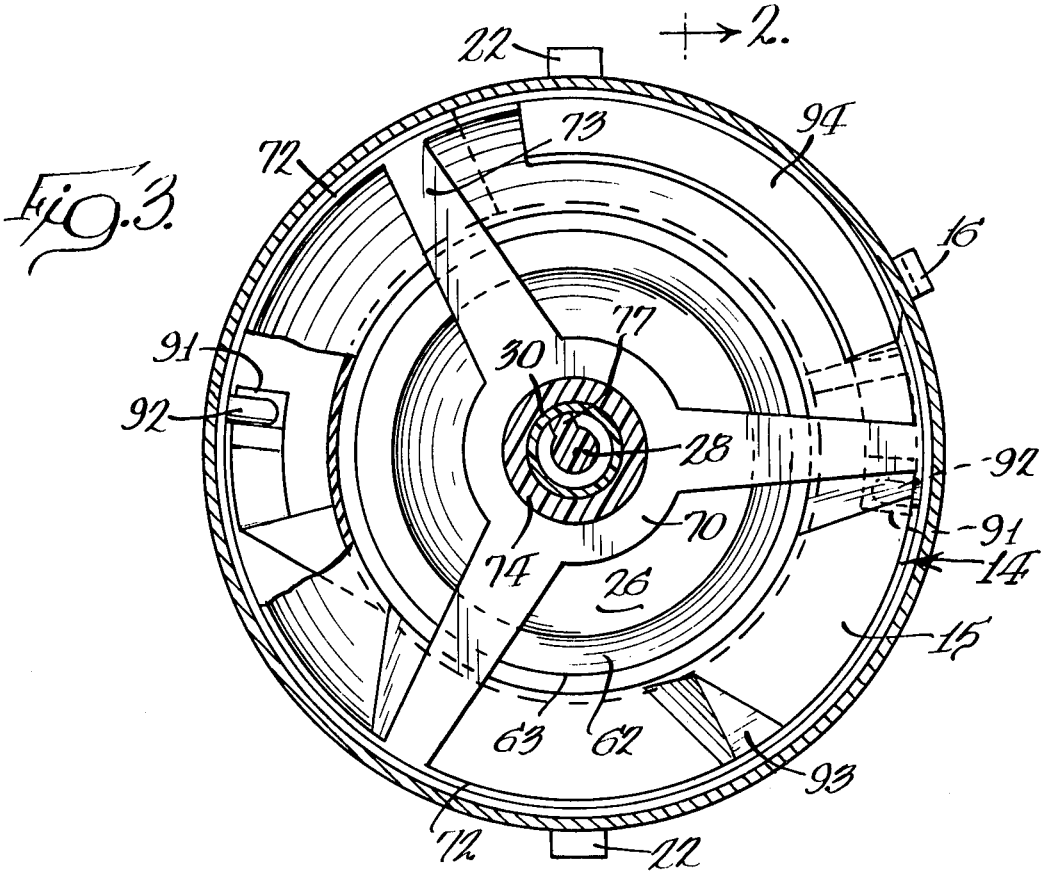
FIG. 3 is a cross-sectional view taken along the plane 3—3 in FIG. 2.

The spraying disk 26 has a central section 64 of stainless steel, with which it engages the shaft 58. The central section 64 has a flat surface 65 on its underside, extending outwardly from a boss 66. The flat surface 65 on the underside of spraying disk 26 is located directly above the flat annular top rim 34 of the bushing 32, and the flat surfaces 65 and 34 define a circular metering opening therebetween. The lower end of the bushing 32 is seated in an upstanding cup 69 forming a part of the hub 70 of a support means which is part of deflector means 14 (FIG. 4) and is detachably mounted to flange 19. As shown in FIG. 3, the support means includes a circumferential rim 72 and a plurality of radial spokes 73 which support the hub 70 and connect the hub to the circumferential rim 72. One end of the rim 72 merges with one end of the deflector 15.

The hub 70 has an inverted cup 74 depending from its lower side in axial alignment with the cup 69, and the feed tube 30 has its upper end secured within the cup 74. The lower end of the feed tube 30 is located near the bottom of the open-topped receptacle 12. The conveyor screw 28 is housed in the feed tube 30 and has its upper end secured to an adapter 75 that extends through a vertical bore in the boss 66 and is secured to the lower end of the shaft 58. Thus, the adapter also affixes the boss 66 of the spraying disk 26 to the shaft 58. The ridges 77 of the conveyor screw 28 are close to the inner surface of the feed tube 30, but have enough clearance to permit rotation of the conveyor screw 28. The helix of the conveyor screw 28 is so directed that rotation of the screw causes the liquid in the receptacle 12 to move upwardly and be forced outwardly through the metering opening between the rim 34 of the bushing 32 and the flat surface 65 of the spraying disk 26.

The amount of liquid that flows through the metering opening is regulated by moving the spraying disk 26 axially relative to the bushing 32 which is stationary. The spraying disk 26 is rigidly secured to the shaft 58, and the motor 24 and the shaft 58 are moved axially to move the spraying disk 26.

The axial movement of the spraying disk 26 is regulated by a control cap 78 having an inner annular flange 79 with a tapered inner surface 80 and a middle annular flange or wall 81 spaced apart from the inner annular flange 79, which middle annular wall 81 has an inner surface in threaded engagement with the collar 49. The cap has an outer annular wall 83 having an inner surface with a recess (not shown), the ends of which engage a clip 82 to limit the rotational movement of the cap.

Heretofore, there have been tolerance problems in setting the control cap 78 in a predetermined position. In accordance with the present invention, when the control cap 78 is in the zero position wherein the metering opening between the flat surface 65 and the top rim 34 of the bushing 32 is zero, the control cap 78 is screwed on to the collar 49 while a frusto-conically shaped tapered member 84, which is cooperatively positioned within the inner annular flange 79, remains loosely positioned therein. The taper of member 84 corresponds to the tapered inner surface 80 of inner flange 79. When the control cap 78 is tightened to the stop position corresponding with the smallest metering opening, a screw 86 is inserted through an aperture in the control cap 78 and into a threaded bore in the tapered member 84. As the screw 86 is tightened, the tapered member 84 moves upwardly and forces the inner annular flange 79 outwardly until a bearing sleeve 87, which is pressfit on the bearing 54 and positioned between the flange 79 and the collar 49, is squeezed between the inner annular flange 79 of the control cap and the collar 49, and thereby fixedly attached to the flange 79 while being movable relative to the stationary collar 49. Thus, the taper in the member 84 and the wall 81 acts as a squeezing mechanism to enable the control cap 78 to securely engage the bearing sleeve 87 at precisely the zero position. The outside surface of the bearing sleeve 87 is in sliding engagement with the inside surface of the collar 49. From the zero position, the control cap 78 can be turned counterclockwise to numbered positions to gradually increase the metered opening between flat surface 65 and the top rim 34 of the bushing 32, the clip 82 limiting the rotational movement of the control cap 78.

As illustrated in FIG. 2, the bearing slide assembly includes the bearing sleeve 87 which, due to the action of the tapered member 84, has a squeeze fit with the inner annular flange 79 of the control cap 78. The screw 86 extends through an aperture in the control cap 78 and holds the tapered member 84 in a fixed position with respect to the control cap. The threaded collar 49 is fixed in position, and rotation of the control cap 78 in either direction results in movement of the bearing slide assembly 53 in an axial direction. The shaft 58 is fixed in the bearings 54 so as to move axially in each direction within the bearing slide assembly 53. The bearing slide assembly 53, the shaft 58, the rotor 57 and the spraying disk 26 move downwardly toward bushing 32 to reduce the dimension of the metering opening when the cap 78 is rotated in a clockwise direction, and away from bushing 32 to increase the dimension of the metering opening when the cap 78 is rotated in the counterclockwise direction. The recess in the cap 78 can be positioned with respect to the clip 82 to limit the rotational movement of the cap to about 160°, so that a maximum rotation of the control cap 78 will move the spraying disk 26 an axial distance of almost one half of the distance between the threads in the collar 49.

Referring to FIGS. 2 and 3, the deflector 15 intercepts most of the liquid thrown outwardly by the spraying disk 26 and directs the liquid back into the receptacle 12. The defector 15 includes a tapered sidewall portion 88, an upper cylindrical wall portion 89 depending from the small diameter end of the tapered sidewall 88, and a lower cylindrical wall portion 72 depending from the larger diameter end of the tapered sidewall 88. The deflector 15 further includes a plurality of supports 91 which project outwardly from the upper cylindrical wall 89. Each of the supports 91 is receivable in a corresponding cylindrical rod segment 92 which is mounted to flange 19 and projects inwardly therefrom, whereby the deflector 15 can be rotated to connect and/or detach the deflector 15 from the remainder of the spray dispenser 10. The deflector 15 further includes a plurality of fins 93 which project inwardly from the tapered sidewall 88 and lower cylindrical wall 72 of the deflector over a portion of its surface to intercept excess liquid and avoid having liquid drip outside the spray dispenser. A discharge opening 94 in a portion of the tapered sidewall 88 and lower cylindrical wall 72 provides a passageway for some of the liquid thrown outwardly by the spraying disk 26, the discharge opening 94 being in registration with an opening 95 in the wall of receptacle 12 so that substantially all the liquid passing through the discharge opening 94 will also pass through the opening 95 to be deposited on the surface to which the liquid is to be applied. The opening 95 is formed by cutting out a section of receptacle 12 along a portion of the upper end thereof. The cut-out section defines the bottom and sides of the opening 95 and the lower edge of the flange 19 of the housing 18 defines the top of the opening 95.

An arc-shaped gate 16 is suspended between the deflector means 14 and the cylindrical wall 72 for sliding movement with respect thereto to cover or uncover a portion of the discharge opening 94, thereby increasing or reducing the area through which the liquid thrown outwardly by the spraying disk 26 may be dispensed. As best illustrated in FIG. 2, the gate 16 has an inner face 96 which is shaped to correspond to the contour of the deflector 15, so that gate 16 is in sliding engagement with the tapered sidewall 88, upper cylindrical wall 89, and lower cylindrical wall 72 of the deflector 15. Additionally, a portion of the outer face 97 of gate 16 is in sliding engagement with the flange 19 of the housing 18, whereby the gate 16 is suspended between the deflector means 14 and the flange 19. The gate 16 also has a shoulder 98 which slides along the bottom edge of the flange 19. A handle 99 is rigidly secured to the gate 16 to facilitate sliding movement of the gate to reduce or increase the length of the discharge opening 94. The supports 91 on the deflector 15 act as a stop means to limit the rotational movement of the gate 16. The suspended nature of the gate 16 facilitates in cleaning the spray dispenser 10 when the deflector means 14 is removed therefrom.

While this invention is susceptible of embodiment in many different forms, there is shown in the drawings and described herein in detail a specific embodiment of the invention, with the understanding that the present disclosure is to be considered as an exemplification of the principles of the invention and is not intended to limit the invention to the embodiment illustrated.

What is claimed is:

1. In a spray dispenser comprising a housing, a receptacle attached thereto for holding a liquid to be dispensed in spray form, a rotatable disk mounted in said housing fo spraying said liquid, motor means including a rotor for rotating said disk, a shaft projecting axially from said rotor, said disk being fixed to said shaft, means for feeding said liquid from said receptacle to the side of said spraying disk which faces the bottom of said receptacle, a fixed member spaced below the underside of said disk and cooperating therewith to define a metering opening therebetween, and means for moving said rotor, shaft and disk axially relative to said housing to vary the size of said metering opening to regulate the volume of liquid fed to said spraying disk, means for setting the metering opening in a predetermined position comprising a threaded collar fixed to said housing, a control cap in threaded engagement with said collar, said control cap having an inner flange with an outer surface and a tapered inner surface, a correspondingly tapered member cooperatively positioned within said inner flange, a sleeve connected to said shaft and being juxtaposed to said outer surface of said inner flange, and means for moving said tapered member axially relative to said inner flange to urge said inner flange into securing engagement with said sleeve, such that rotation of said cap in first direction moves said sleeve, shaft and disk away from said fixed member to increase the size of said metering opening and rotation of said cap in the opposite direction moves said sleeve, shaft and disk toward said fixed member to decrease the size of said metering opening.

2. In a spray dispenser as defined in claim 1 wherein said cap has an aperture therethrough, said tapered member has a threaded bore, and said means for urging said tapered member axially comprises a screw which is disposed in said aperture and said bore and moves said tapered member into securing engagement with said sleeve as said screw is turned.

3. In a spray dispenser as defined in claim 1 wherein said control cap has a threaded middle flange outwardly spaced from said inner flange and which is in threaded engagement with said collar, said sleeve being positioned between said inner flange and said middle flange, such that said tapered inner flange and said middle flange act as a squeezing mechanism to enable said control cap to securely engage said sleeve at the desired predetermined position.

4. In a spray dispenser as defined in claim 1 wherein said receptacle has an opening through which said spray is directed; delector means are provided for attachment to said housing to intersect the liquid which is directed in a path other than through the opening and direct said liquid back into said receptacle; and said liquid feeding means, said fixed member and said deflector means are unitary to facilitate cleaning of said spray dispenser.

5. In a spray dispenser as defined in claim 4 wherein a plurality of projecting members are mounted on said housing and project inwardly therefrom, and said deflector means includes a plurality of outwardly directed supports which are receivable in said projecting members upon rotation of said deflector means, such that said deflector means can be connected to or detached from said housing to facilitate cleaning thereof.

6. In a spray dispenser as defined in claim 5 wherein a movable gate means is suspended between said deflector means and said housing, such that movement of said gate means varies the length of said opening in said receptacle and facilitates cleaning when said deflector means is detached from said housing.

7. In a spray dispenser comprising a housing which terminates in a lower edge, a receptacle which has an upper end, is attached to said housing, and holds a liquid to be dispensed in spray form through an opening in said dispenser, a rotatable disk mounted in said housing for spraying said liquid, motor means including a rotor for rotating said disk, a shaft projecting axially from said rotor, said disk being fixed to said shaft, means for feeding said liquid from said receptacle to the side of said spraying disk which faces the bottom of said receptacle, a fixed member spaced below the underside of said disk and cooperating therewith to define a metering opening therebetween, and means for moving said rotor, shaft and disk axially relative to said housing to vary the size of said metering opening to regulate the volume of liquid fed to said spraying disk, wherein deflector means is attached to said housing to intersect liquid which is directed in a path other than through the opening in said dispenser and direct said liquid back into said receptacle, wherein a plurality of projecting members are mounted on said housing and project inwardly therefrom, and said deflector means includes a plurality of outwardly directed supports which are receivable in said projecting members upon rotation of said deflector means, such that said deflector means can be connected to or detached from said housing to facilitate cleaning thereof.

8. In a spray dispenser as defined in claim 7 wherein said deflector means and said receptacle are removably attached to said housing, and a movable gate means is positioned between and slidably engages said deflector means and said housing, and wherein said gate means is supported by and releasably retained between said deflector means and said housing, such that movement of said gate means varies the length of said opening in said dispenser, and removal of said receptacle and said deflector means facilitates removal of said gate means from said spray dispenser for cleaning said spray dispenser.

9. In a spray dispenser as defined in claim 8 wherein said liquid feeding means, said fixed member and said deflector means are unitary to facititate cleaning of said spray dispenser.

10. In a spray dispenser as defined in claim 7 wherein said liquid feeding means, said fixed member and said deflector means are unitary to facilitate cleaning of said spray dispenser.

11. In a spray dispenser comprising a housing which terminates in a lower edge, a receptacle which has an upper end, is attached to said housing, and holds a liquid to be dispensed in spray form through an opening in said dispenser, a rotatable disk mounted in said housing for spraying said liquid, motor means including a rotor for rotating said disk, a shaft projecting axially from said rotor, said disk being fixed to said shaft, means for feeding said liquid from said receptacle to the side of said spraying disk which faces the bottom of said receptacle, a fixed member spaced below the underside of said disk and cooperating therewith to define a metering opening therebetween, and means for moving said rotor, shaft and disk axially relative to said housing to vary the size of said metering opening to regulate the volume of liquid fed to said spraying disk, said receptacle having a cut-out section along a portion of the upper end thereof, said cut-out section defining the bottom and sides of said opening and the lower edge of said housing defining the top of said opening, wherein deflector means are provided for attachment to said housing to intersect the liquid which is directed in a path other than through the opening and direct said liquid back into said receptacle, wherein said liquid feeding means, said fixed member and said deflector means are unitary to facilitate cleaning of said spray dispenser, and wherein a plurality of projecting members are mounted on said housing and project inwardly therefrom, and said deflector means includes a plurality of outwardly directed supports which are receivable in said projecting members upon rotation of said deflector means, such that said deflector means can be connected to or detached from said housing to facilitate cleaning thereof.

12. In a spray dispenser as defined in claim 11 wherein a movable gate means is suspended between said deflector means and said housing, such that movement of said gate means varies the length of said opening in said receptacle and facilitates cleaning when said deflector means is detached from said housing.

* * * * *

UNITED STATES PATENT AND TRADEMARK OFFICE

CERTIFICATE OF CORRECTION

PATENT NO. : 4,049,197

DATED : September 20, 1977

INVENTOR(S) : Frans Brouwer

It is certified that error appears in the above-identified patent and that said Letters Patent are hereby corrected as shown below:

Column 2, line 22, after "motor" insert --driven--

Column 3, line 68, delete "a"

Column 5, line 34, change "defector" to --deflector--

Column 6, line 32, change "fo" to --for--

Column 6, line 56, after "in" insert --a--

Column 7, line 12, change "defector" to --deflector--

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*